US007140125B2

(12) United States Patent
Singleton et al.

(10) Patent No.: US 7,140,125 B2
(45) Date of Patent: Nov. 28, 2006

(54) HIGH-HEELED FASHION SHOE WITH COMFORT AND PERFORMANCE ENHANCEMENT FEATURES

(75) Inventors: Angela Singleton, 7420 Merrimusic Cir., Severn, MD (US) 21144; Mark Marion, Wayland, MA (US); Tiffany Card, New Haven, CT (US)

(73) Assignee: Angela Singleton, Baltimore, MD (US)

( * ) Notice: Subject to any disclaimer, the term of this patent is extended or adjusted under 35 U.S.C. 154(b) by 0 days.

(21) Appl. No.: 10/969,259

(22) Filed: Oct. 20, 2004

(65) Prior Publication Data

US 2005/0081401 A1 Apr. 21, 2005

Related U.S. Application Data

(60) Provisional application No. 60/516,426, filed on Oct. 31, 2003, provisional application No. 60/512,682, filed on Oct. 20, 2003.

(51) Int. Cl.
*A43B 21/30* (2006.01)

(52) U.S. Cl. ..... 36/38; 36/34 R; 36/37; 36/24.5; 36/91; 36/152; 36/174

(58) Field of Classification Search ..... 36/105, 36/34 R, 37, 38, 151, 152, 168, 91, 24.5, 36/174, 177, 180
See application file for complete search history.

(56) References Cited

U.S. PATENT DOCUMENTS

| | | | | | |
|---|---|---|---|---|---|
| 1,255,794 | A * | 2/1918 | Santella | 36/168 |
| 1,580,497 | A * | 4/1926 | Klein | 36/180 |
| 1,671,713 | A * | 5/1928 | Glass | 36/179 |
| 2,079,820 | A * | 5/1937 | Scott | 36/158 |
| 2,114,526 | A * | 4/1938 | Feder | 36/168 |
| 2,407,498 | A * | 9/1946 | Johnson | 36/108 |
| 2,500,591 | A * | 3/1950 | Watkins et al. | 36/173 |
| 2,512,350 | A * | 6/1950 | Ludlam | 36/179 |
| 2,814,132 | A * | 11/1957 | Montoscuro | 36/37 |
| 2,836,907 | A * | 6/1958 | Windle | 36/38 |
| 2,852,865 | A * | 9/1958 | Spalding | 36/37 |
| 2,967,362 | A * | 1/1961 | Montoscuro | 36/37 |
| 3,044,191 | A * | 7/1962 | Cayo | 36/34 R |
| 3,124,910 | A * | 3/1964 | Levine | 451/26 |
| 4,066,206 | A | 1/1978 | Peterson | 229/69 |
| 4,416,072 | A * | 11/1983 | Sarkissian | 36/100 |
| 4,566,206 | A | 1/1986 | Weber | 36/7.8 |
| 4,848,008 | A | 7/1989 | Kuehnle et al. | 36/35 |
| 4,910,885 | A | 3/1990 | Hsieh | 36/37 |
| 4,972,612 | A * | 11/1990 | Prukop et al. | 36/91 |
| 5,195,258 | A | 3/1993 | Loader | 36/38 |
| 5,203,095 | A | 4/1993 | Allen | 36/27 |
| 5,311,680 | A * | 5/1994 | Comparetto | 36/154 |
| 5,435,079 | A | 7/1995 | Gallegos | 36/38 |
| 5,875,567 | A | 3/1999 | Bayley | 36/27 |
| 5,896,679 | A | 4/1999 | Baldwin | 36/27 |
| 6,101,743 | A * | 8/2000 | Brown | 36/102 |
| 6,192,607 | B1 * | 2/2001 | Kolada et al. | 36/145 |
| 6,901,686 | B1 | 6/2005 | Hayes | 36/27 |

* cited by examiner

*Primary Examiner*—Marie Patterson
(74) *Attorney, Agent, or Firm*—St. Onge Steward Johnston & Reens LLC

(57) ABSTRACT

High-heeled footwear has a heel with a resilient compressible element allowing the heel of the foot to be lowered at heel strike to approximate a normal walking pattern in low-heeled shoes. Preferably, the footwear also includes a midfoot support structure, which may be a sprung footbed, or a sling and reinforcement girder, and which serves to redistribute load from the wearer's forefoot to her midfoot.

25 Claims, 7 Drawing Sheets

FIG. 13
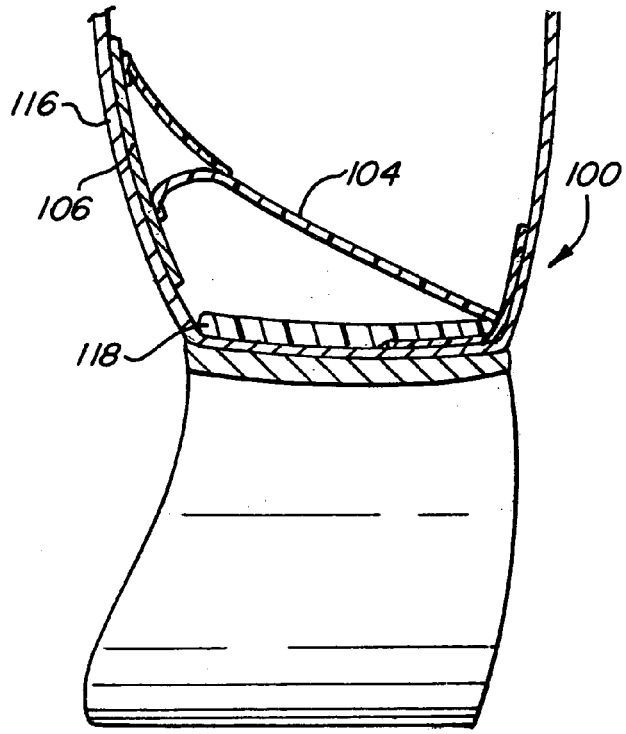
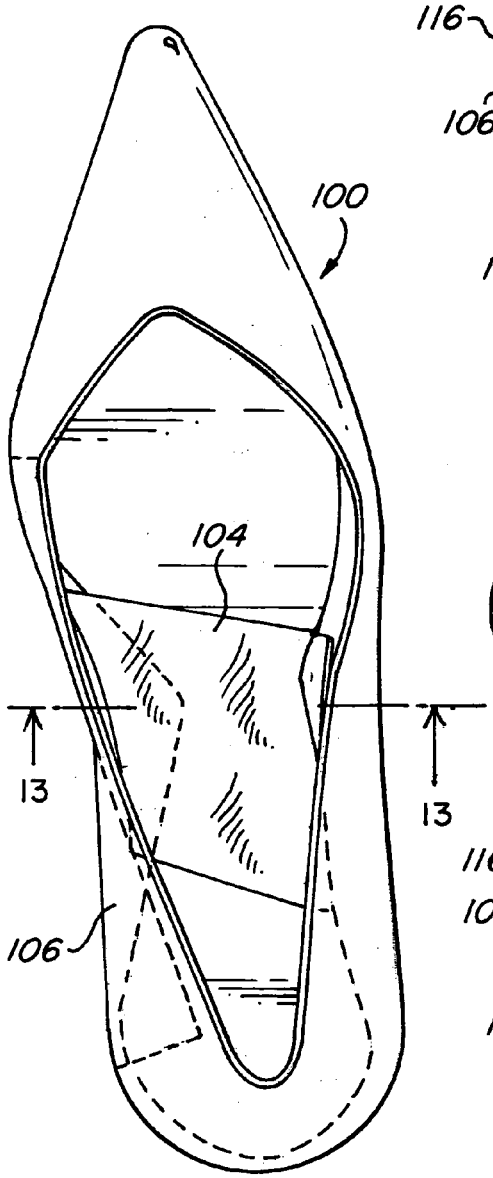
FIG. 12
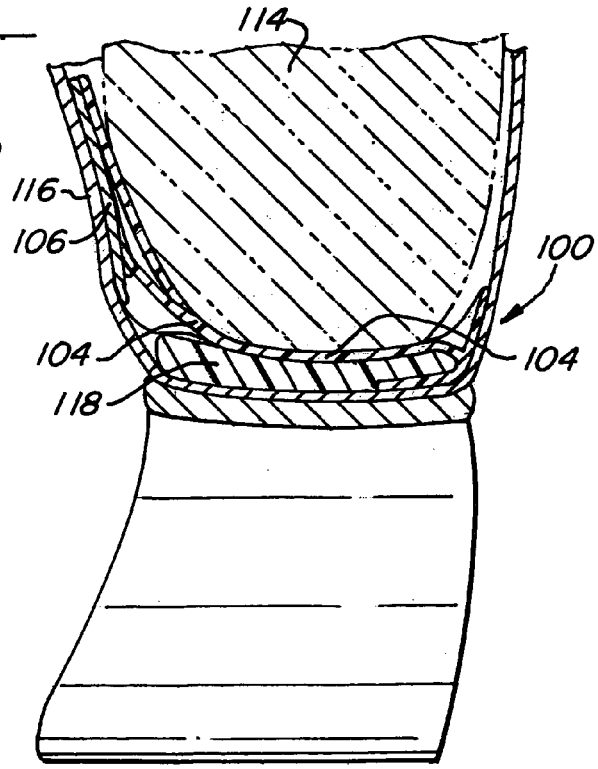
FIG. 14

HIGH-HEELED FASHION SHOE WITH COMFORT AND PERFORMANCE ENHANCEMENT FEATURES

RELATED APPLICATIONS

This patent application claims priority under 35 U.S.C. §119(e) of U.S. Provisional Patent Application Nos. 60/512,682, filed Oct. 20, 2003, and 60/516,426, filed Oct. 31, 2003.

FIELD OF THE INVENTION

The present invention relates generally to high heeled footwear typically worn by women. More particularly, the present invention relates to improvements to high-heeled footwear to increase comfort and performance, apparatus employing such improvements, and methods of walking using the improved footwear of the invention.

BACKGROUND OF THE INVENTION

Conventional high heeled footwear is often uncomfortable, tiring, and even painful to wear and to walk in. There are several medical problems associated with wearing high heels, including foot, ankle, knee, hip, and lower back problems. Yet many women still wear high-heeled footwear regularly because it can make the wearer more stylish, elegant, professional, and/or sexy, and to make the wearer look taller. Some men also wear such high-heeled footwear, for example in certain oriental cultures; also, high-heeled footwear is often worn by cross-dressing transvestite men.

The discomfort and pain from wearing high-heeled footwear arises because high-heeled footwear significantly alters the wearer's stance/posture and natural walking gait cycle. In flat shoes, the weight distribution is approximately 5% over the phalanges, 40% over the metatarsals, 5% over the midfoot, and 50% in the heel areas of the foot. Thus body weight is relatively evenly distributed between the front part and the rear part of the foot. High-heeled footwear alters the angle that the wearer's foot projects forwardly from the leg, so that the weight load of the body cannot be supported in the same way as the foot in a natural position. In a high heeled shoe with a two inch heel, 70% of the wearer's body weight is borne by the balls of the wearer's foot. As heel height increases, the percentage of body weight carried by the balls of the foot is increased. The raised heel causes disproportionate loading in the forefoot and slippage of the foot into the toe part when standing or walking. A substantial percentage of high-heeled shoe wearers report pain associated with the wearing of such footwear within one to four hours of typical walking, standing, and sitting found in a work or social environment. In many high-heeled shoes the steep ramp of the shoe causes the foot to slide downwardly, crowding and cramping the toes. Without a doubt, high-heeled shoes are uncomfortable to stand in or walk in for long periods of time.

Foot problems from wearing high heeled shoes also arise because regular use of high heels causes calf muscles and tendons to shorten relative to their normal length without shoes. The higher the heel height, the more contracted the calf muscles will become over time. At first, the symptoms include a temporary effect in which the calf muscles can still be stretched out after wearing high heels all day. Eventually, a permanent shortening of the muscles and tendons occurs. Once shortened there is a risk that the Achilles tendons can tear if the calf muscles and Achilles tendons are stretched beyond their new shorter length. Ironically, there are many women who cannot wear flat shoes because of this problem, and the pain associated with it. To avoid this problem a woman must remember to stretch the muscles and tendons after wearing high heels.

Normal walking involves at each step a "heel strike" when the heel comes in contact with the ground, a "roll" from the heel through the ball of the foot, and then lifting the ball of the foot from the ground at the "toe off." Heel contact at the heel strike is more abrupt when wearing high heels, causing the wearer to slam her body weight onto the balls of the feet to complete the roll, thus subjecting the ball of the foot to abnormal pressure levels. With greater impact and higher dynamic loads at the heels and metatarsals due to raised heels, the natural shock absorbers of the foot do not provide sufficient protection, resulting in various degenerative changes and injury.

SUMMARY OF THE INVENTION

A high-heeled shoe to be worn on a foot of a wearer comprises a high heel; and a spring element provided in or with the high heel which serves to lower a heel of the foot of the wearer during a heel strike to approximate a normal walking pattern; the shoe preferably further includes a sprung midfoot support structure which distributes a load across at least a portion of the foot and provides an energy return. The invention and its particular features and advantages will become more apparent from the following detailed description considered with reference to the accompanying drawings.

BRIEF DESCRIPTION OF THE DRAWINGS

FIG. 12 is a top plan view of a high-heeled shoe with a sling and a reinforcement girder in accordance with certain embodiments of the present invention.

FIG. 13 is a rear cross-sectional view of a cutaway of a high-heeled shoe with a sling under no load conditions in accordance with certain embodiments of the present invention.

FIG. 14 is a rear cross-sectional view of a cutaway of a high-heeled shoe with a sling under load conditions in accordance with certain embodiments of the present invention.

DETAILED DESCRIPTION OF CERTAIN ADVANTAGEOUS EMBODIMENTS

The features of certain embodiments of the present invention described below are suited for use with any of a variety of types of high-heeled footwear. "High-heeled" has different meanings to different populations. In the fashion trade, medium heels are heels which are 1.0 inch to 2.5 inches in height and high heels are heels which are 2.5 inches or higher in height. Medical professionals in the orthopedic field tend to define high heels as heels which are 2.0 inches or higher in height. Consumers often view any heel over 1.5 inches in height as a "high heel". For purposes of this application, the terms "high heel" or "high heeled" refer to heels having a height of 1.5 inches or more. In the preferred embodiments of the invention, the term "high-heeled" refers to heels having a height of 2.0 inches or more; or 2.5 inches or more; or greater than 2.5 inches; or 3.0 inches or more, or 4.0 inches or more. The use of the term "shoe" in the following detailed description and claims is not intended to be limiting in any fashion, but to apply to any form of high-heeled footwear that a given feature may be added to. Although each Figure depicts high-heeled footwear of a given design, that is merely for convenience in order to illustrate various features of the present invention and serve as examples of various designs of high-heeled footwear. It is not intended to limit use of various features of the present invention to the illustrated high-heeled footwear designs, and the present invention is applicable to high heeled pumps, sandals and other high-heeled footwear. Similarly, the word "walking" is used for convenience, and includes running, jogging, or other types of pedal locomotion.

Figure 1:
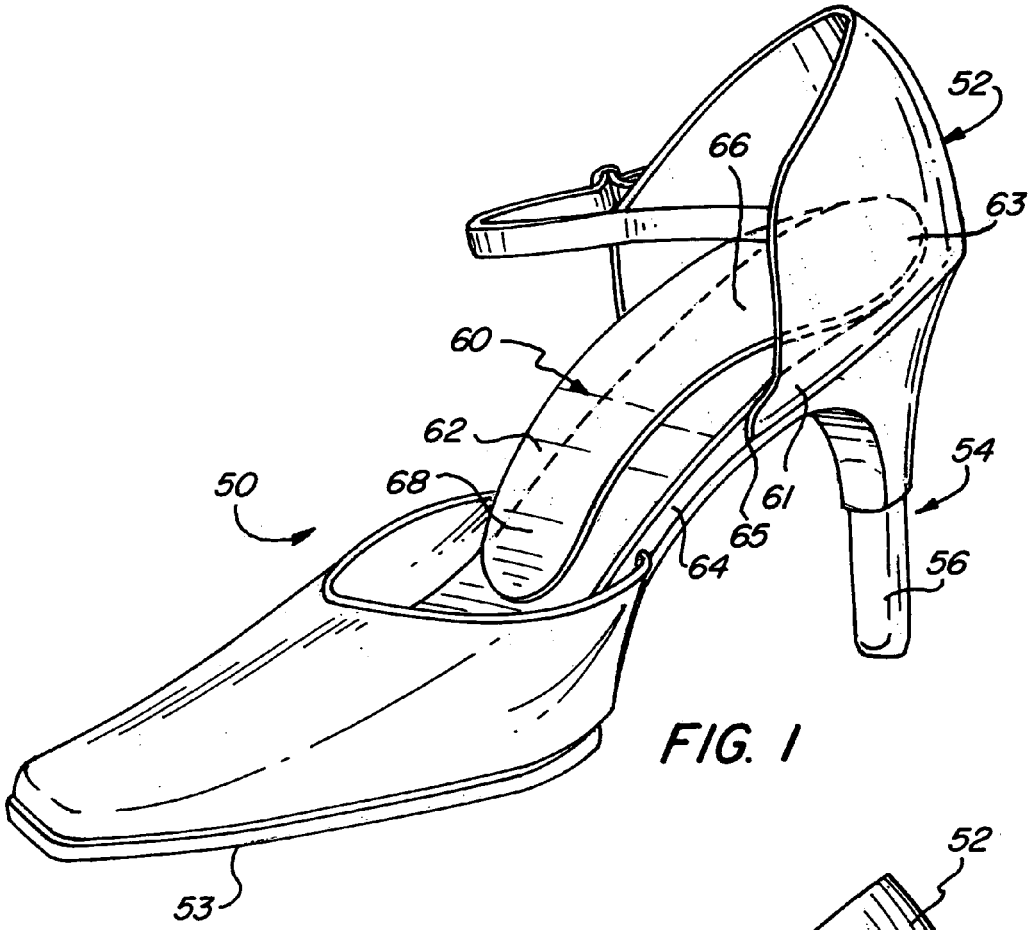
FIG. 1 is a side perspective view of a high-heeled shoe with a spring element configured to lower the high heel at heel strike and a midfoot support structure in accordance with one embodiment of the present invention.
Figure 2:
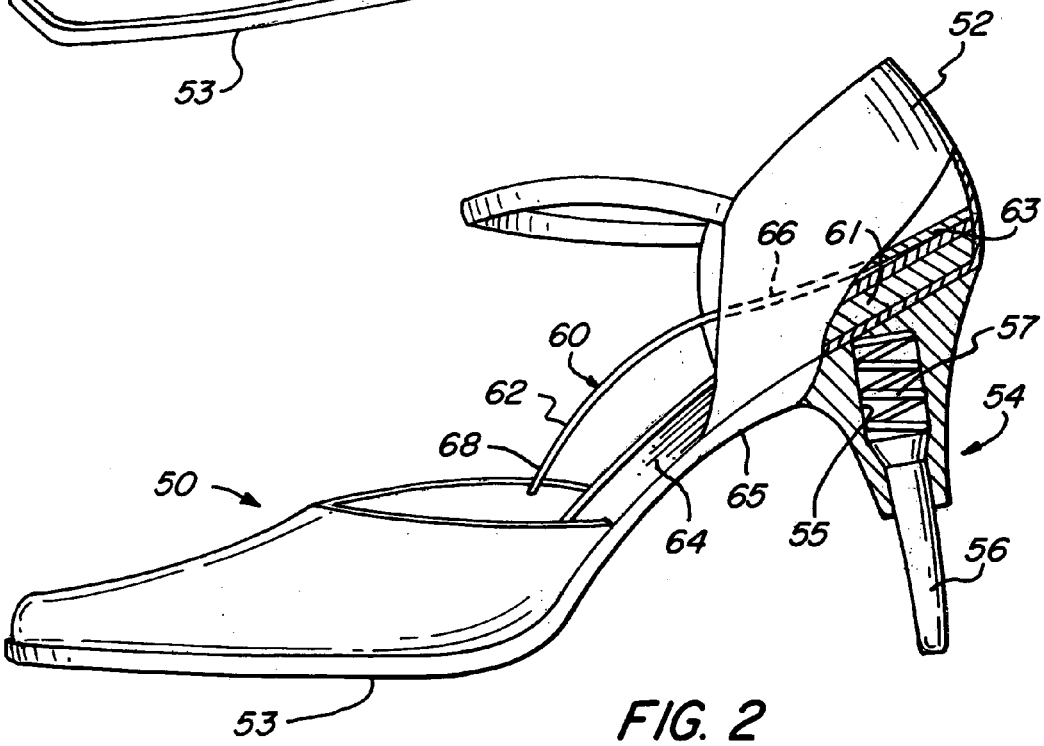
FIG. 2 is a side elevation view with partial cutaway of the shoe of FIG. 1.

With reference first to FIGS. 1 and 2, a perspective view of a high-heeled shoe 50 in accordance with certain embodiments of the present invention is shown. The shoe 50 is designed to provide increased comfort and performance to a wearer, and to reduce the risk of injury from wearing high-heeled footwear. The shoe 50 includes an upper 52, and outsole 53 and a high heel 54 with a heel stem 56 configured so that the high heel 54 is lowered at heel strike. Therefore, the heel of the foot of the wearer is lowered at heel strike, and the wearer approaches the natural gait foot angle and a more normal walking pattern. In certain embodiments the lowering of the high heel 54 also serves to provide energy storage and energy return to enhance forward momentum in the course of walking. In certain embodiments the heel or spring features are angled rearwardly instead of being vertically positioned, in order to direct the energy return forwardly to provide a forward propelling energy to the wearer which in effect will thrust the wearer forward. The high heel is lowered through the use of a spring element, which can be configured in various fashions, as will be described below. The shoe 50 also includes a midfoot support structure 60, which distributes load more evenly across the foot, rather than having an excessive amount of load focused on the ball of the foot as happens with traditional high-heeled shoes. In certain embodiments, the midfoot support structure 60 also provides storage and return of energy when the shoe and its wearer are in motion, enhances forward momentum, bears a load, reduces shock absorption, and/or increases stability for wearers. In certain embodiments an insole surface 62 with a greater coefficient of friction than conventional shoe insoles is added to restrict slippage of the foot into the toe area and reduce toe crowding and toe pain. In alternative embodiments (as shown in FIGS. 12 and 14) the shoe includes a sling built into the molding of the sole, insole of the shoe, or sidewall of the shoe upper in order to distribute body weight more evenly across the mid-foot, reducing the load at the metatarsal region and providing arch support.

It is apparent from the foregoing description that the present invention relates to various comfort and performance enhancement features for high-heeled footwear, some or all of which are included in various embodiments.

Referring specifically to FIGS. 1 and 2, high-heeled shoe 50 has a coil spring-loaded high heel 54 configured to lower the high heel 54 at heel strike when the wearer is walking. FIG. 1 shows the shoe 50 as it would look to an observer, while FIG. 2 provides a cutaway view of the spring-loaded heel stem 54. High heel 54 includes a cylindrical sleeve 55, a heel stem 56, and a coil spring 57. When the wearer is walking, the heel strike causes the heel stem 56 to move telescopically upwardly against the pressure of the spring 57. As the wearer continues moving forward, coil spring 57 pushes the heel stem 56 downwardly to provide an energy return and to propel the walker forward, assisting in the transition from heel strike to toe off during the walking cycle.

Figure 3A:
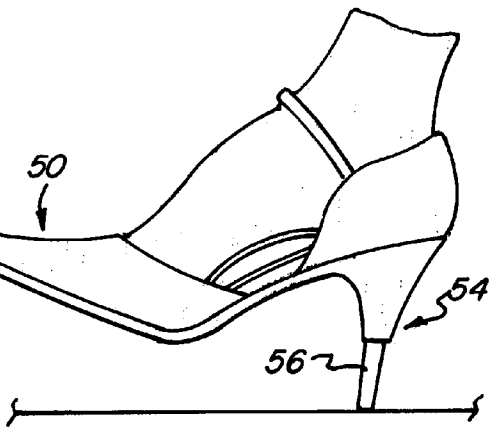
FIG. 3*a* is a side elevation view of the high-heeled shoe of FIG. 1 showing the heel strike step of walking.
Figure 3B:
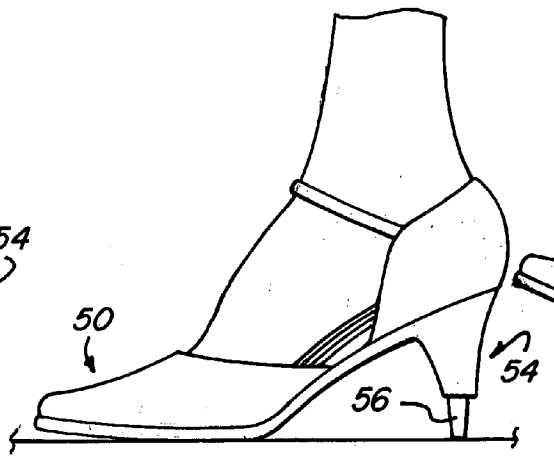
FIG. 3*b* is a side elevation view of the high-heeled shoe of FIG. 3*a* during the roll step of walking.
Figure 3C:
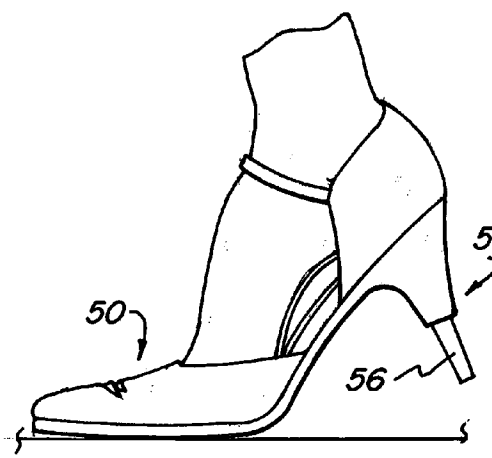
FIG. 3*c* is a side elevation view of the high-heeled shoe of FIG. 3*a* during the toe off step of walking.

The operation of the high-heeled shoe of FIG. 1 is illustrated in FIGS. 3*a*–3*c*. FIGS. 3*a*, 3*b*, and 3*c* present side elevation views of high-heeled shoe 50 configured to lower the high heel 54 at heel strike. FIG. 3*a* shows the shoe 50 at the heel strike step of walking. FIG. 3*b* shows the shoe 50 at a time during the roll step of walking in which the height of the high heel is reduced to lower the heel of the foot of the wearer during heel strike and the first part of a roll-off, and FIG. 3*c* shows the shoe at a time prior to the toe off step of walking.

Figure 4A:
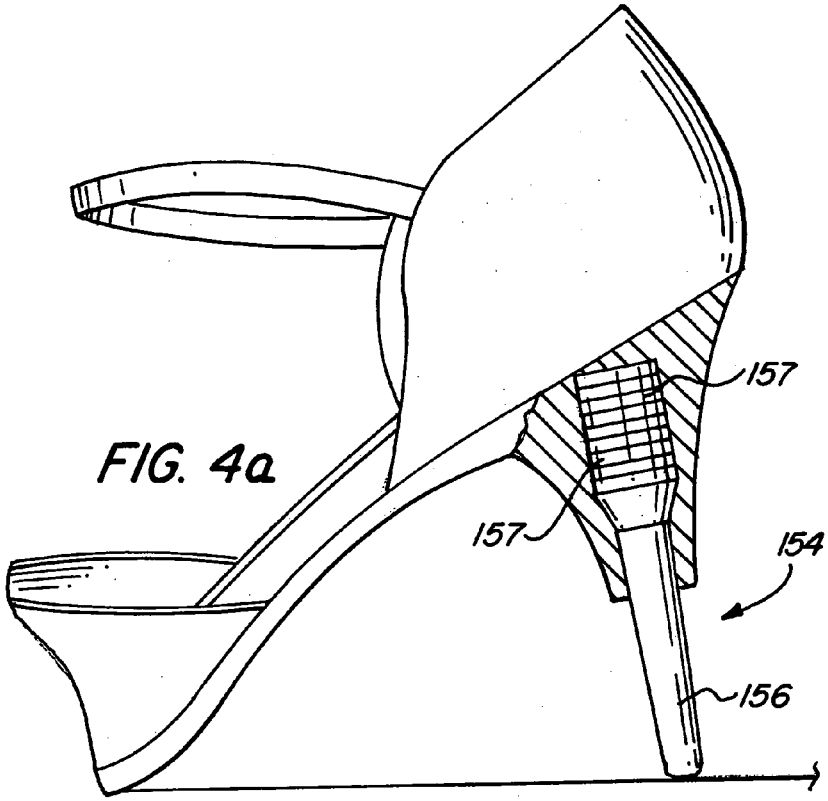
FIG. 4*a* is a rear elevation view with partial cutaway showing another embodiment of a high heeled shoe with a resilient spring element.
Figure 4B:
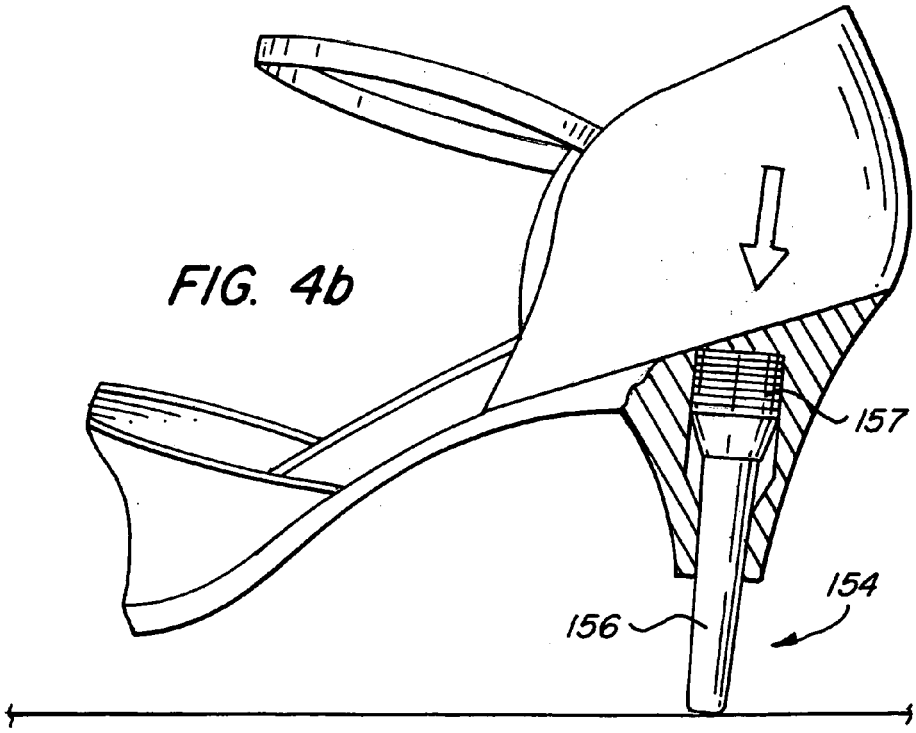
FIG. 4*b* is a rear elevation view with partial cutaway showing another embodiment of a high heeled shoe with a resilient spring element which has been compressed under load to lower the heel of the shoe.

Referring to FIGS. 4*a* and 4*b*, an alternative spring element that is operable to reduce the height of the high heel in a high-heeled shoe and to lower the heel of the foot of a wearer during heel strike is shown. In contrast to the coil spring 57 shown in the heel 54 of high-heeled shoe 50 in FIGS. 1 and 2, the high heel 154 of the shoe in FIGS. 4*a* and 4*b* uses a compressible resilient polymeric material to obtain the desired performance. High heel 154 may use a plurality of resilient disks 157 that compresses when pressure is applied via heel stem 156 (as seen in FIG. 4*b*). These resilient disks then return to their original shape and return the heel stem 156 to its extended position.

Although the spring elements illustrated in the drawings include coil springs, resilient elements and leaf springs, the means to obtain the desired function may include numerous other embodiments, including springs such as seen in U.S. Pat. Nos. 5,195,258; 4,566,206; and other arrangements, however, the spring system must be adapted to obtain the intended heel lowering step.

Other alternative means to obtain the same desired function may include pneumatic piston systems; hydraulic systems, magnetic repulsion systems, and battery powered active systems could also be used. In addition, a combination of these spring element systems could be used, for example, a combined coil spring and magnetic repulsion system.

Figure 5A:
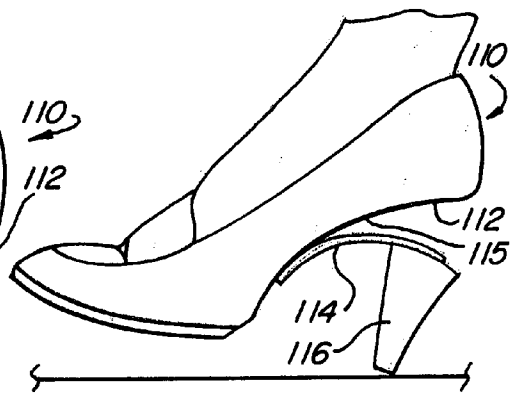
FIG. 5*a* is a side elevation view of another embodiment of a high-heeled shoe in accordance with the invention showing the heel strike step of walking.
Figure 5B:
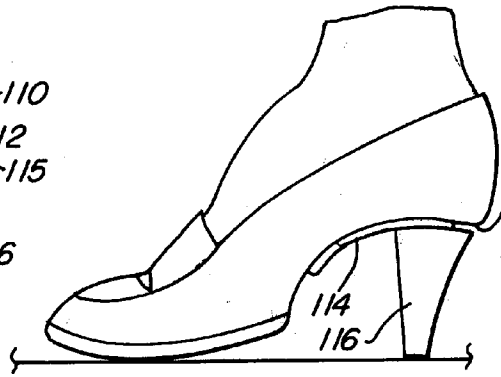
FIG. 5*b* is a side elevation view of the high-heeled shoe of FIG. 5*a* during the roll step of walking.
Figure 5C:
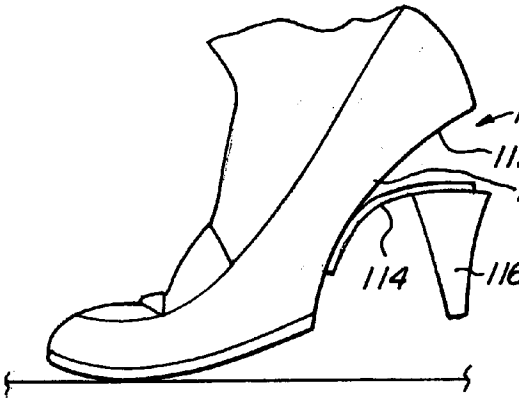
FIG. 5*c* is a side elevation view of the high-heeled shoe of FIG. 5*a* during the toe off step of walking.

FIGS. 5*a*–5*c* illustrates one such alternative embodiment, a high-heeled shoe 110 with a leaf spring system. FIG. 5*a* shows the shoe 110 at the heel strike step of walking, FIG. 5*b* shows the shoe 110 at a time during the roll step of walking, and FIG. 5*c* shows the shoe 110 just prior to the toe-off step of walking. High heeled shoe 110 has a leaf spring element 114 extending horizontally from the downward sloping region 115 of the outsole, and a heel stem 116, which extends substantially vertically to the ground. In these embodiments the heel stem 116 is rigid. As can be seen by examining the transition from FIG. 5*a* to FIG. 5*b*, a heel-lowering step occurs when the heel area 112 of the insole is dropped down toward the heel stem 116 during the heel strike, decreasing the angle between the heel area 112 and the heel stem 116. When the heel is lifted off the ground, as in FIG. 5*c*, the leaf spring element 114 returns to its original position and the heel height is restored. In the example shown in FIGS. 5*a*–5*c*, there is a visible gap between the shoe upper 113 and the heel stem 116. The shoe sole in the heel area 112 may be reinforced to support load without any perceptible flexing of the leaf spring element 114 when the wearer is stationary. Further, for fashion or safety reasons, the volume between the heel area 112 and the element 114 may be filled or enclosed with a flexible or rigid shroud, shield or curtain.

Figure 7:
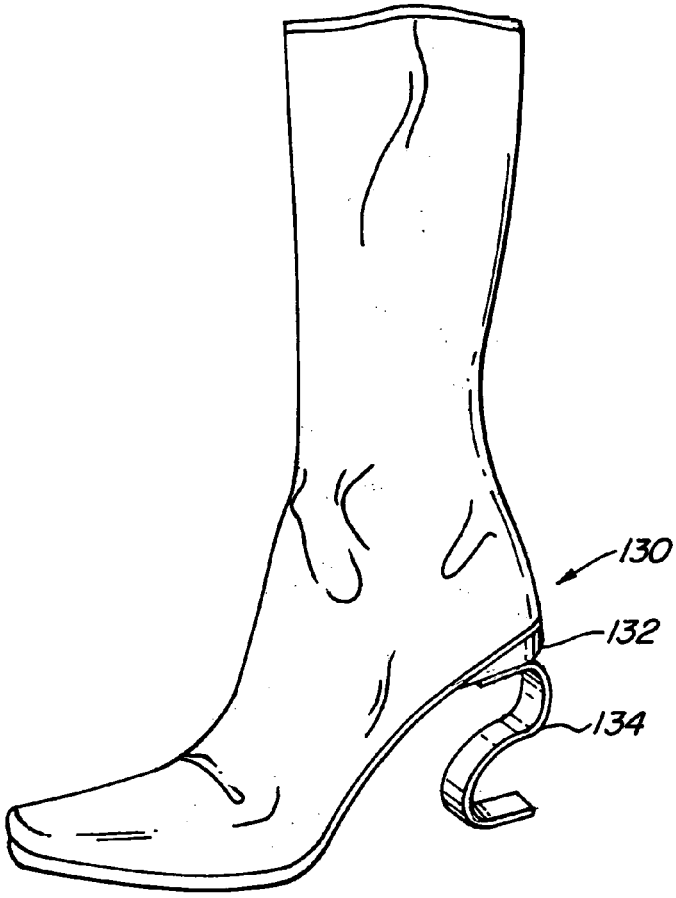
FIG. 7 is a perspective view of the high-heeled shoe of FIG. 6.
Figure 6:
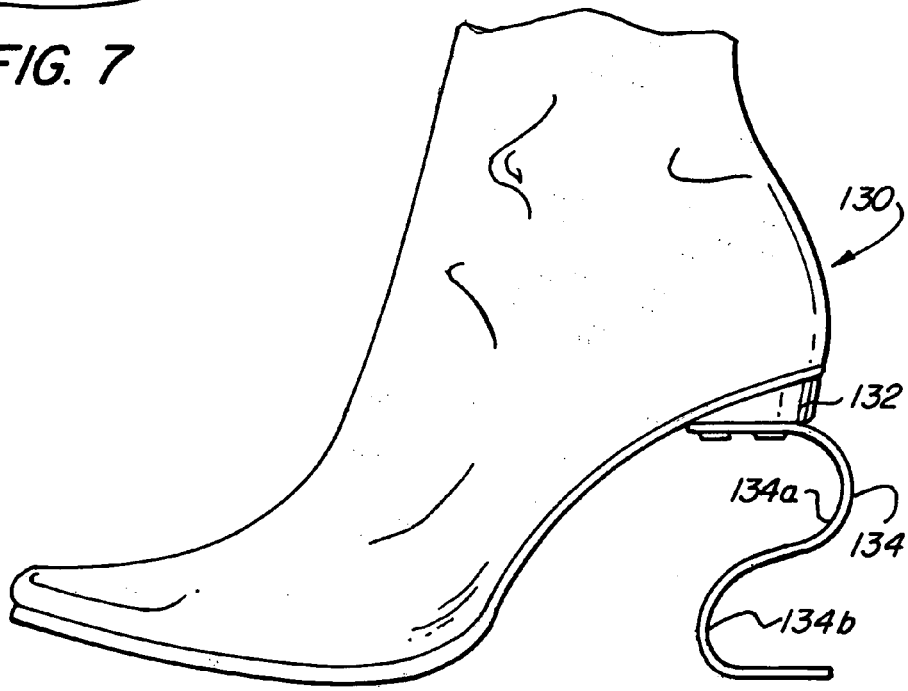
FIG. 6 is a side elevation view of a high-heeled shoe with a sinusoidal, wavy, or counter-contoured curved one-part spring element configured to lower the high heel at heel strike in accordance with certain embodiments of the present invention.

With reference now to FIGS. 6 and 7, a high-heeled shoe 130 with a sinusoidal, wavy, or counter-contoured curved one-part spring element is shown. The heel stem 134 is configured to lower the heel area 132 at heel strike. The heel stem 134 extends from the heel area 132 to the ground with one or more alternating convex and concave curves, such as curves 134*a* and 134*b*. The terms "convex" and "concave" are used herein to designate curving in opposite directions, not to define a given curve direction as either "concave" or "convex." The vertical compression occurs within each of the curves 134*a* and 134*b* at the heel strike as shown by the arrows in FIG. 6. Although FIG. 6 depicts two curves 134*a* and 134*b*, in certain other embodiments as few as one curve or more than two curves are used.

In the various heel-lowering spring element systems disclosed above, it is to be appreciated that the spring element ideally should be designed to fully support the wearer's weight without compression when the wearer is stationary or shifting her feet slowly. The heel compression and lowering is intended to occur when the wearer begins walking, particularly vigorously. Given a median body weight for each shoe size, it is possible to select a spring system that will provide the desired response for a median weight person. However, as it is expected that there will be a performance variation between a person who weights 100 pounds and a person who weights 200 pounds, it may be appropriate to offer commercial product in at least three spring settings. Thus there might be "light", "medium" and "heavy" versions of the same shoe, with a spring system designed to provide the desired amount of heel-lowering during heel strike. One design option would be to design the spring element system to operate as described above for a load×which represents a median customer weight, and to develop alternative versions of the spring element system which operate as described at a load 1.3× for a heavier customer, and a load 0.8× for a lighter customer.

A significant parameter of the shoe design is the amount of heel lowering. The present invention contemplates a minimum heel lowering deflection of 0.5 inch during active walking. In the most preferred embodiment there is 1 inch of heel lowering deflection during active walking. Thus, in the preferred embodiment, a 4.0 inch heel will be lowered to 3.0 inches, a 3.0 inch heel will be lowered to 2.0 inches, a 2.5 inch heel will be lowered to 1.5 inches, and a 2.0 inch heel will be lowered to 1.0 inch. However, as noted above, the amount of deflection will be dependent on the weight of the wearer and the qualities of the spring element. Thus there is the potential for higher amounts of deflection, of as much as 1.5 inches or 2.0 inches, depending on the spring element design and the load applied to the spring element. In order to prevent excessive deflection which might be detrimental to the wearer or which might present an unstable walking style, a limiter on spring element travel should be provided. The deflection limitation can be inherent in the spring element length, or a separate deflection limiter can be provided. For example, in FIG. 1, the cylindrical sleeve 55 will have a length, and the length of that sleeve will determine the amount of deflection. If the distance between the lower end of cylindrical sleeve 55 and the ground is 1 inch in a normal resting state, then the maximum amount of deflection will be 1 inch, since the cylindrical sleeve 55 does not itself provide any deflection. Other limiters on travel can be provided, for example, stops in such cylindrical sleeve 55 to prevent excessive movement of the heel stem 56 within cylindrical sleeve 55.

Furthermore, as discussed with reference to FIGS. 5*a*–5*c*, the heel lowering system may require some type of shroud or camouflage to enclose functional elements which are non-conventional in appearance. Thus, a heel as shown in FIGS. 5*a*–5*c* may require a covering which will cover the spring element when stationary, but which will fold or give when the spring element is compressed. An alternative would be a rigid shroud with a clearance, or opening, at the bottom to allow for travel of the shroud through a series of positions during the wearer's gait cycle. Alternatively, clearance about the circumference of the insole at the back part of the shoe and a hollowed out upper portion of the heel stem will allow the insole and spring to deflect into the hollow of a rigid heel stem.

Various embodiments of high-heeled footwear with a midfoot support structure will be discussed in connection with FIGS. 1, 2, and 8–11. In FIGS. 1 and 2, a high-heeled shoe 50 has a midfoot support structure 60. The midfoot support structure 60 includes an upper plate 66 and a lower plate 68, and the midfoot support structure is at least partially contained in the mid-foot area 64 of the high-heeled shoe 60. The upper plate 66 is affixed to the heel area 63 of shoe 50 by screws, nails, adhesive, over molding, or any of a variety of attachment techniques. The midfoot support structure 60 extends forwardly from the heel area of the high-heeled shoe 50 towards the midfoot area 64 of the shoe and potentially into the area beneath the balls of the foot. In other embodiments the midfoot support structure extends further in either or both directions, and in still other embodiments the midfoot support structure is affixed either at the front 61 of the heel area 63 or the area 65 between the heel area and the midfoot area, or in the midfoot area 64.

The midfoot support structure 60 is configured so as to be compressible along a downward sloping area of the high-heeled shoe 50, in particular the mid-foot area 64 of high-heeled shoe 50. Thus the midfoot support structure 60 is sprung and provides a spring resilience. In certain embodiments the midfoot support structure 60 is relatively stiff, while in other embodiments the midfoot support structure 60 is relatively flexible. In certain embodiments the midfoot support structure 60 is configured to correspond to a shape of at least a portion of the foot of the wearer, by including features such as a bend in the midfoot support structure 60. The bend corresponds to the midfoot contour of the foot of the wearer.

Figure 8:
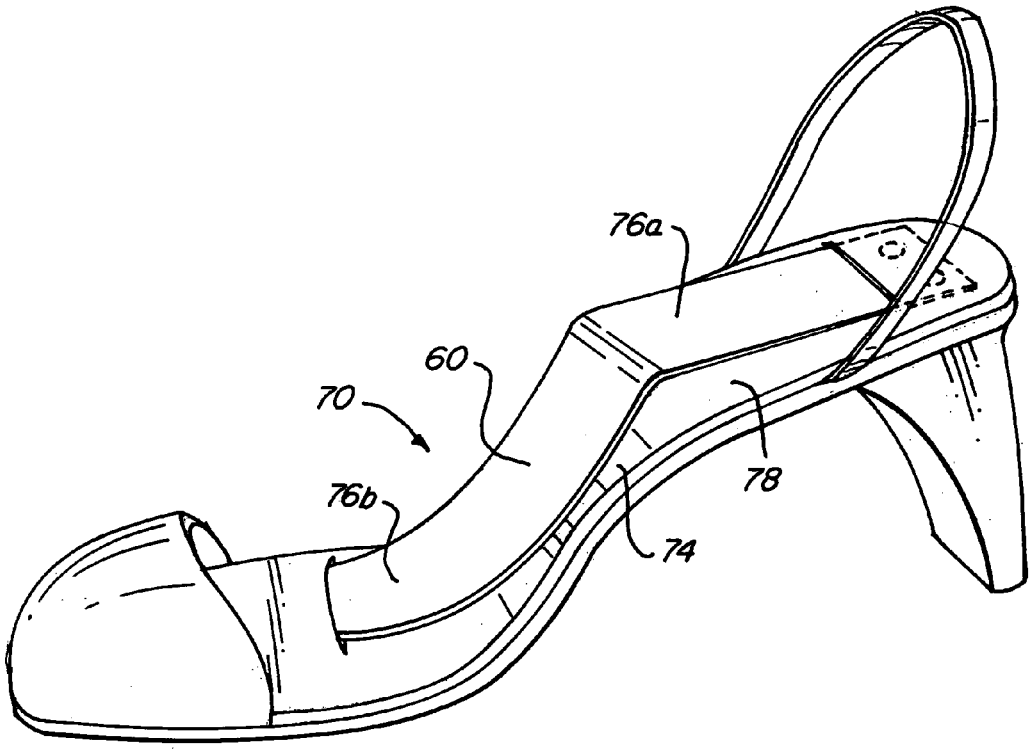
FIG. 8 is a top and side perspective view of a high-heeled shoe with a midfoot support structure in accordance with another embodiment of the present invention.
Figure 9:
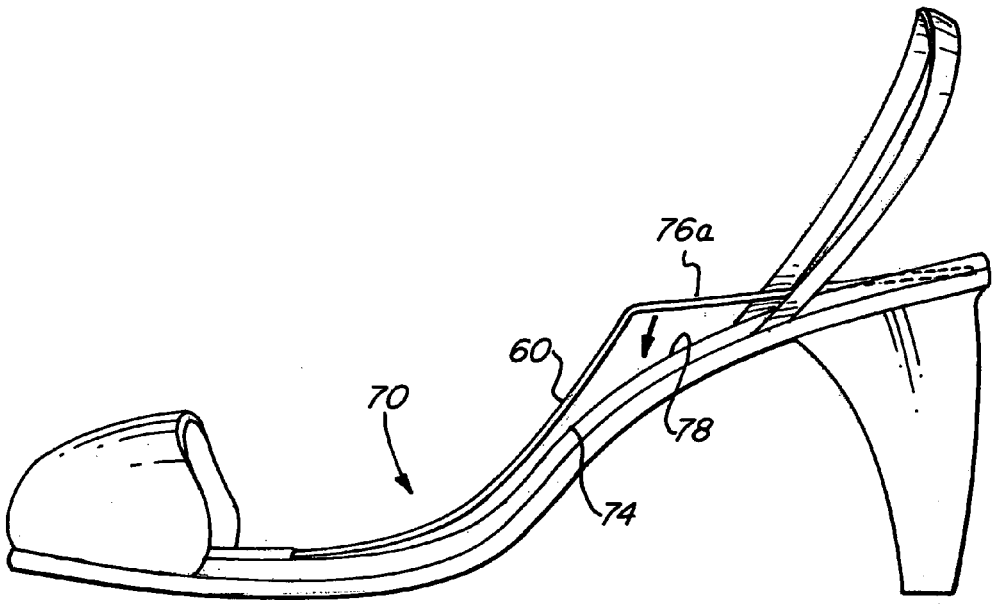
FIG. 9 is a side elevation view of the high-heeled shoe of FIG. 8.

With reference next to FIGS. 8 and 9, a high-heeled shoe 70 with a mid-foot support structure 60 in accordance with certain embodiments of the present invention is shown. The midfoot support structure 60 includes a plate 76, which has a first end 76*a* and a second end 76*b*. In the embodiments depicted by FIGS. 8 and 9, the plate 76 is coupled to the insole 78 of the shoe at the first end 76*a*. Various couplings are used depending on the embodiment, such as a pivot. In certain embodiments the plate 76 is also coupled at the second end 76*b*, while in other embodiments the second end 76*b* of the plate 76 is free. In still other embodiments not represented by FIG. 8, the first end 76*a* is free. The plate 76 is configured so as to be compressible along a downward sloping area of said high-heeled shoe, namely, the mid-foot area 74 of said high-heeled shoe. In that fashion, the plate 76 serves as a spring element of the mid-foot support structure. The midfoot support structure has features similar to some of the features of the midfoot support structure described in connection with FIGS. 1 and 2.

Figure 10:
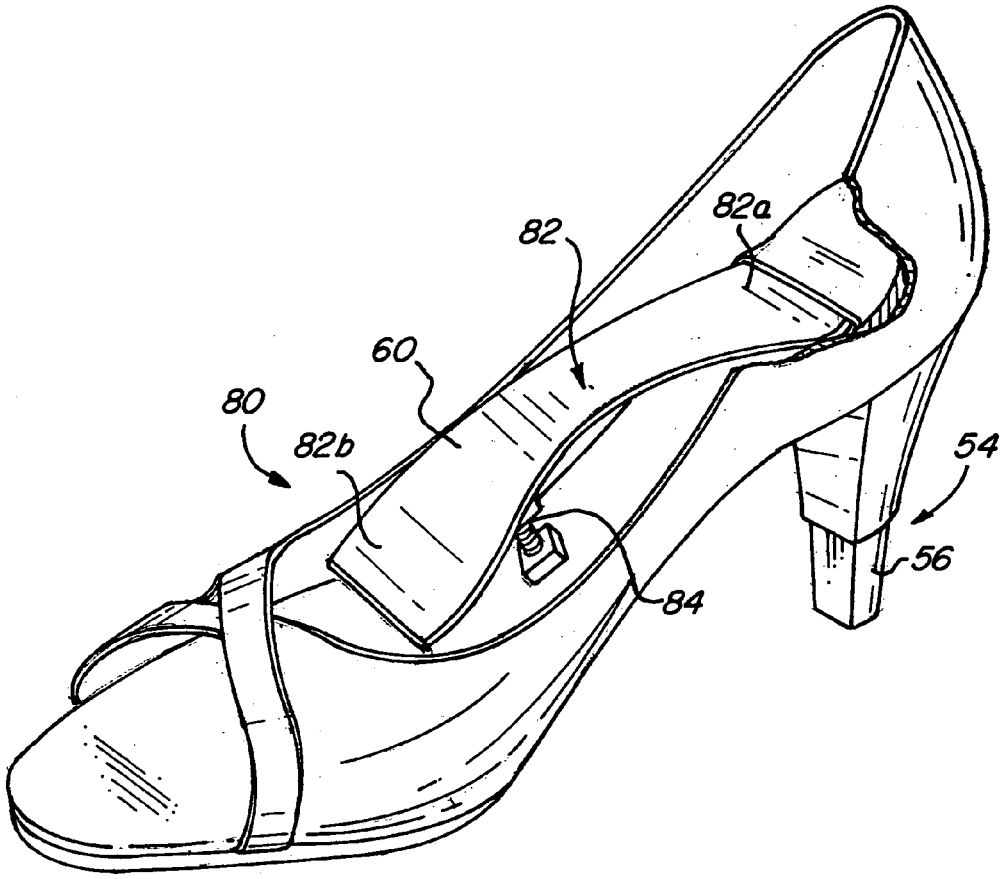
FIG. 10 is a top and side perspective view of a high-heeled shoe with a midfoot support structure in accordance with another embodiment of the present invention.
Figure 11:
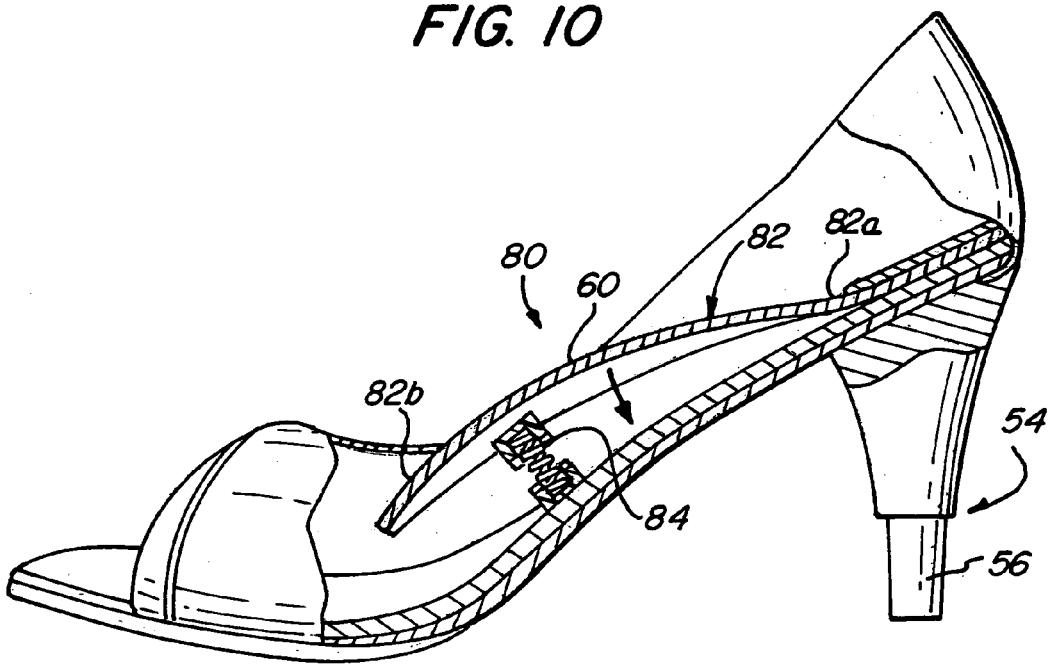
FIG. 11 is a side elevation view of the high-heeled shoe of FIG. 10.

FIGS. 10 and 11 disclose another high-heeled shoe 80 in accordance with the invention, in which the midfoot support structure 60 has an accessory spring 84. The midfoot support structure 60 includes a plate 82, which has a first end 82*a* and a second end 82*b*. The plate 82 is coupled with the insole and/or the sole at the first end 82*a*, while the second end 82*b* of the plate is free. The plate 82 is configured so as to be compressible along a downward sloping area of the high-heeled shoe 80. In that fashion, the plate 82 serves as a first spring element of the midfoot support structure. A separate accessory spring element 84 serves as a second spring element of the midfoot support structure to enhance the functionality of the midfoot support structure. The midfoot support structure has features similar to the midfoot support structures described in connection with FIGS. 1, 2 and 8 and 9.

The midfoot support structure 60 desirably provides an energy return to the wearer when walking due to its spring characteristics. The midfoot support structure is a desirably a leaf spring and in one embodiment may include several layers of a flexible material joined to act as a single unit. In certain of these and other embodiments, the midfoot support structure 60 are configured so that the thickness is varied across the midfoot support structure 60 to allow for varying degrees of flex. In certain embodiments, the flex is of a predetermined amount corresponding to the weight and/or gait of the user. In certain embodiments the midfoot support structure 60 are constructed with slits, stamped out areas, depressions, and/or cutaways to avoid contact of the midfoot support structure 60 with sensitive areas of the foot of the user. Also, in certain embodiments, a frictional surface 62 may be added to further restrict the potential for foot slippage along the downward slope and to further prevent jammed and crowded toes.

The midfoot support structure 60 provides some resistance to the downward pressure of the body weight, thereby reducing the impact on the ball of the foot and arch area of the foot. This prevents excessive pressure from being borne by the metatarsals and results in increased comfort and foot flexibility. Also, the structural configuration of certain embodiments provides an increased level of energy return compared to what is obtainable without the midfoot support structure 60.

High-heeled footwear with a midfoot support structure in the form of a sling with a reinforcement girder is shown in FIGS. 12–14. FIG. 12 illustrates a high-heeled shoe 100 with a sling 104 and a reinforcement girder 106 in accordance with certain embodiments of the present invention. In certain embodiments only the sling 104 is present, while in certain other embodiments only the reinforcement girder 106 is present. They are both shown in FIGS. 12–14 for convenience and to show the interaction between the two elements in the case that both are present. As seen in FIG. 12, the sling 104 is a suspended sling that distributes body weight more evenly across the mid-foot, reducing the load at the metatarsal region, and suspending at least part of the midfoot, in certain embodiments including the arch, in order to provide buffer from the shock effects generated when walking or running. The suspended sling also provides arch support.

The reinforcement girder 106 is a stiff strip of material extending along a portion of the circumference of the instep. When used in combination with the sling 104, the girder 106 eliminates gaping edges along the waist of the shoe, streamlines the appearance of the foot, and increases the sturdiness of the backpart. The reinforcement girder 106 also supports the sling 104 to prevent collapse of the instep girth. In certain embodiments the reinforcement girder 106 is made of metal such as spring steel, or leather, plastic or other springy materials, or a combination of these materials and/or other materials.

FIGS. 13 and 14 are rear elevation views of a cutaway view of shoe 100 of FIG. 12 with sling 104 under no load conditions and under load conditions, respectively, in accordance with certain embodiments of the present invention. FIG. 13 shows the sling 104 without a foot in the high-heeled shoe, while FIG. 14 shows the sling 104 with a foot 114 of a wearer. In the embodiments shown in FIGS. 13 and 14, the sling 104 is built into a side-part 116 of the shoe upper. In certain other embodiments, however, the sling 104 is instead built into the molding 118 of the sole or insole. This latter approach is more appropriate when the high-heeled shoe is a sandal or a slingback, as those shoes may lack shoe uppers. As can be seen in particular in FIG. 13, the sling 104 is a suspended sling. In certain embodiments, the shoe also has a reinforcement girder 106 coupled to the sling 104, while in other embodiments there is no reinforcement girder.

In certain embodiments of the present invention making use of various combinations of the just described enhancements, the shoe looks no different to an observer than a shoe without the enhancements. Therefore, the fashion value of high-heeled footwear does not need to be sacrificed in order to achieve the increased comfort and performance contemplated by the present invention. For example, while a wearer is stationary, the heels are at a full height comparable to traditional high-heeled shoes, even if the particular shoe contains the high heel configured to be lowered at heel strike.

In order to make use of various embodiments of the high-heeled shoe, and specifically a high-heeled shoe with a high heel configured to be lowered at heel strike, certain embodiments of the present invention contemplate a new method for walking using the described footwear. The wearer has on a heel-heeled shoe that includes a spring element configured to lower a high heel at heel strike, and raise the high heel when the heel is lifted off of the walking surface. When walking, the wearer contacts the bottom of a heel stem of the high heel with the walking surface, which actuates the spring element, causing the high heel to lower, thereby more closely approximating a normal walking pattern. Next, the wearer rolls the shoe from the heel to the ball of the foot and the heel leaves the ground, which causes the spring element to release and raise the high heel back to its initial position. Finally, the wearer lifts the ball of the foot from the walking surface. In a preferred embodiment of the footwear having a midfoot support structure, when walking the wearer contacts the heel stem with the walking surface, and rolls from the heel to the ball of the foot. While the wearer is rolling to the ball of the foot, a portion of the wearer's foot actuates a spring element of the midfoot support structure, which causes a load to be redistributed from the ball of the foot to a middle portion of the foot and to the heel of the foot. The wearer then lifts the ball of the foot from the walking surface, and the spring element is returned to its initial position. In certain embodiments, both this method and the previously described method are combined into a single method of walking.

Although the invention has been described with reference to a particular arrangement of parts, features and the like, these are not intended to exhaust all possible arrangements or features, and indeed many other modifications, combinations, and variations will be ascertainable to those of ordinary skill in the art.

What is claimed is:

1. A high-heeled shoe, comprising:

an outsole;

at least a partial shoe upper;

a high heel block, having a height of 1.5 inches or greater, affixed to said outsole, said high heel block enclosing a heel stem telescopically received in said heel block and downwardly urged by a spring element, said heel stem and heel block being configured to substantially lower a heel of the foot of the wearer during a heel strike; and a sprung midfoot support structure located above said outsole, said midfoot support structure extending from a heel area of said high-heeled shoe into at least a portion of the midfoot and ball areas of said high-heeled shoe area and distributing a first portion of a load otherwise borne by a ball of the foot of the wearer to a middle portion of the foot of the wearer, and distributing a second portion of the load otherwise borne by a ball of the foot of the wearer to a heel of the foot of the wearer.

2. The high-heeled shoe of claim 1, wherein said spring element lowers the heel of the foot of the wearer by between about 0.5 inches to about 2.0 inches.

3. The high-heeled shoe of claim 2, wherein said spring element lowers the heel of the foot of the wearer by about 1.0 inch.

4. The high-heeled shoe of claim 1, wherein said means to reduce the height of said high heel comprises a coil spring or leaf spring.

5. The high-heeled shoe of claim 1, wherein said sprung midfoot support structure is affixed in a heel area of said shoe.

6. The high-heeled shoe of claim 1, wherein the spring element is of a predetermined stiffness selected according to a weight of the wearer.

7. The high-heeled shoe of claim 1, wherein said heel stem is telescopically received in a sleeve in said high heel block.

8. The high-heeled shoe of claim 1, wherein said midfoot support structure extends forwardly from a heel area of said high-heeled shoe.

9. The high-heeled shoe of claim 8, wherein said midfoot support structure further comprises one or more accessory springs located between said midfoot support structure and an outsole of said high-heeled shoe.

10. The high-heeled shoe of claim 1, wherein said midfoot support structure has a thickness which is varied along a length of said midfoot support structure sufficiently to provide a varying degree of flex along said length of said midfoot support structure.

11. The high-heeled shoe of claim 1, wherein said midfoot support structure is provided with a frictional surface having a sufficient friction to reduce sliding of the wearer's foot on the midfoot support structure.

12. The high-heeled shoe of claim 1 wherein said midfoot support structure includes a curved plate having a first end located in an area of said shoe for receiving a heel of a foot and a second end located in an area of said shoe for receiving a ball of a foot.

13. The high-heeled shoe of claim 12, in which said second end of said curved plate of said midfoot support structure is curved to provide a concave upper surface.

14. A high-heeled shoe, comprising:

an outsole;

at least a partial shoe upper;

a high heel block, having a height of 1.5 inches or greater, affixed to said outsole, said high heel block enclosing a heel stem telescopically received in said heel block and downwardly urged by a spring element, said heel stem and heel block being configured to substantially lower a heel of the foot of the wearer at least 0.5 inches during a heel strike.

15. The high-heeled shoe of claim 14, wherein the spring element is of a predetermined stiffness selected according to a weight of the wearer.

16. The high-heeled shoe of claim 14, wherein said heel stem is telescopically received in a sleeve in said high heel block.

17. The high-heeled shoe of claim 14, wherein said spring element lowers the heel of the foot of the wearer by about 0.5 inches to about 2.0 inches.

18. The high-heeled shoe of claim 17, wherein said spring element lowers the heel of the foot of the wearer by about 1.0 inch.

19. The high-heeled shoe of claim 14, wherein said spring element comprises a coil spring or leaf spring.

20. A method of walking for a wearer of a high-heeled shoe, comprising:

placing a shoe having a high heel on a foot of the wearer, the high heel having a spring element allowing a heel stem of the shoe to retract from a first position to a second position such that in the second position the high heel is lowered to change the wearer's walking pattern to a pattern that the wearer would follow if the wearer were wearing a substantially lower heel, and for extending the heel stem of the shoe to return to said first position, thereby raising the high heel of the high-heeled shoe;

contacting the heel stem of the high heel of the high-heeled shoe with a walking surface, wherein upon contact the spring element is actuated, thereby lowering the high heel from the first position to the second position;

rolling the foot from the heel to a ball of the foot, wherein the heel leaves the ground and the spring element is released, thereby raising the high heel from the second position to the first position; and lifting the ball of the foot from the walking surface.

21. A high-heeled shoe, comprising:

an outsole;

at least a partial shoe upper;

a high heel having a height of 1.5 inches or greater; and sprung midfoot support structure located above said outsole, said midfoot support structure consisting of a curved plate having a first end located in a heel area of said shoe and extending to a second end located in an area of said shoe for receiving a ball of a foot, said curved plate having a concave upper surface adjacent said second end thereof and distributing a first portion of a load otherwise borne by a ball of the foot of the wearer to a middle portion of the foot of the wearer, and distributing a second portion of the load otherwise borne by a ball of the foot of the wearer to a heel of the foot of the wearer.

22. The high-heeled shoe of claim 21, wherein said sprung midfoot support structure provides an energy return.

23. The high-heeled shoe of claim 21, wherein said midfoot support structure extends forwardly from a heel area of said high-heeled shoe.

24. The high-heeled shoe of claim 21, wherein said midfoot support structure has a thickness which is varied along a length of said midfoot support structure sufficiently to provide a varying degree of flex along said length of said midfoot support structure.

25. The high-heeled shoe of claim 21, wherein said midfoot support structure is provided with a frictional surface having a sufficient friction to reduce sliding of the wearer's foot on the midfoot support structure.

* * * * *